United States Patent [19]

Campbell et al.

[11] 4,303,166

[45] Dec. 1, 1981

[54] HORIZONTAL SLEWING CRANE

[75] Inventors: George T. R. Campbell, Nassau, The Bahamas; Kosaku Ohno, Asaka; Toshishige Kasuga, Kawasaki, both of Japan

[73] Assignee: Algoship International Limited, Nassau, The Bahamas

[21] Appl. No.: 191,443

[22] Filed: Sep. 29, 1980

Related U.S. Application Data

[63] Continuation of Ser. No. 870,811, Jan. 18, 1978, abandoned.

[30] Foreign Application Priority Data

Jan. 18, 1977 [JP] Japan ..... 52-4336

[51] Int. Cl.[3] ..... B66C 23/54

[52] U.S. Cl. ..... 212/233; 212/245; 212/227; 414/682; 414/744 R

[58] Field of Search ..... 212/227, 228, 232, 233, 212/245, 261; 414/682, 744 R

[56] References Cited

U.S. PATENT DOCUMENTS

| | | | |
|---|---|---|---|
| 2,834,480 | 5/1958 | Przyblyski | 212/248 |
| 2,921,701 | 1/1960 | Ireland | 212/231 |
| 3,045,836 | 7/1962 | Evans | 212/238 |
| 3,073,397 | 1/1963 | Balogh | 212/163 |
| 3,098,395 | 7/1963 | Haganes | 212/245 |
| 3,430,503 | 3/1969 | McLaughlin | 212/245 |
| 3,658,187 | 4/1972 | Campbell et al. | 212/193 |

FOREIGN PATENT DOCUMENTS

| | | | |
|---|---|---|---|
| 1294893 | 3/1969 | Fed. Rep. of Germany | 212/245 |

*Primary Examiner*—Lawrence J. Oresky
*Attorney, Agent, or Firm*—Larson and Taylor

[57] ABSTRACT

A crane having a fixed mast and a boom pivotally mounted at the top of the mast for movement in a horizontal plane through at least 180° and in a vertical plane downwardly from the horizontal plane at any position of the boom relative to the vertical axis of the mast, a load carrying trolley movable along the length of the boom, hydraulic means located at the top of the mast controlling the movement of the boom in the horizontal plane and hydraulic means between the boom and the mast controlling movement of the boom in the vertical plane.

2 Claims, 7 Drawing Figures

HORIZONTAL SLEWING CRANE

This is a continuation, of application Ser. No. 870,811 filed Jan. 18, 1978 now abandoned.

This invention is directed towards an improved crane, particularly to a crane of the type having an upright post and a boom hinged at one end to the post for movement in both a vertical plane and in a horizontal plane relative to the vertical axis of the post.

Cranes of the above type are commonly employed on board ships as well as in shore installations to load and unload cargo. The boom is usually attached at one end to the lower portion of the post and in some cases to the upper portion of the post, by a universal type hinge whereby the boom can be swung about the vertical axis of the post and raised or lowered relative to the post about a horizontal axis. The hinge between the boom and the post employs a movable hinge member, a horizontal pivot pin or pins between the hinge member and the boom, and a vertical pivot pin between the hinge member and the post. Normally, the boom in this type of crane is moved in both the vertical plane and in the horizontal plane by rope means connected to a winch, the winch being located either at deck or ground level or on the post. Cargo lifting and lowering is accomplished by rope means directed over pulleys on the post and boom.

The disadvantages of the above described prior art are, first, the total load of the boom and the load carried by the boom is concentrated on the hinge parts, and particularly on the vertical hinge pin, requiring that the hinge parts be of large size, and the torque required to move the hinge parts relative to each other is excessive, and, secondly, that the large size of the hinge parts impose a limit well under 180°, through which the boom can be swung horizontally about the vertical axis of the post.

In the present invention there is disclosed a crane characterized in that a boom has one end swingably attached to the upper portion of a post, one end of a lever is pivoted to the top of the post at a position spaced apart from a center of rotation of the boom by a predetermined distance and the other end of the said lever is connected through linkage to the boom; and the pivotal point of the lever with respect to the post, the center of rotation of the boom and the pivotal point of the linkage with respect to the boom are in line with respect to each other; and one end of a straight-line mechanism such as a cylinder and piston device is pivotally connected to the lever whereby the translation or straight-line movement of the straight-line mechanism may be converted into the swinging motion of the said boom through the lever and linkage.

The device is further characterized in that the cylinder and piston device is slidably mounted to be moved towards or away from the boom in such a way that when the boom is lowered into a storage position, the piston rod of the cylinder and piston device may be extended over a minimum stroke.

It is therefore one object of the present invention to provide an improved crane which avoids the use of universal connections between the post and the boom, thus greatly simplifying the construction of the crane over the known prior art.

It is another object of the present invention to provide an improved crane on which the boom can be swung about the post through an arc greater than 180° thus providing increased range for the crane in handling cargo.

It is a further object of the present invention to eliminate the use of rope gear for control of the crane boom in both the horizontal plane and the vertical plane, and to replace such rope gear by hydraulic means concentrated adjacent the hinge between the crane post and the movable boom.

These and other objects of the invention will be apparent from the following detailed specification and the accompanying drawings, in which FIG. 1 is a diagrammatic showing of the principle of operation of the crane of the present application showing the movement of the crane boom through 180°.

Figures 1, 2:
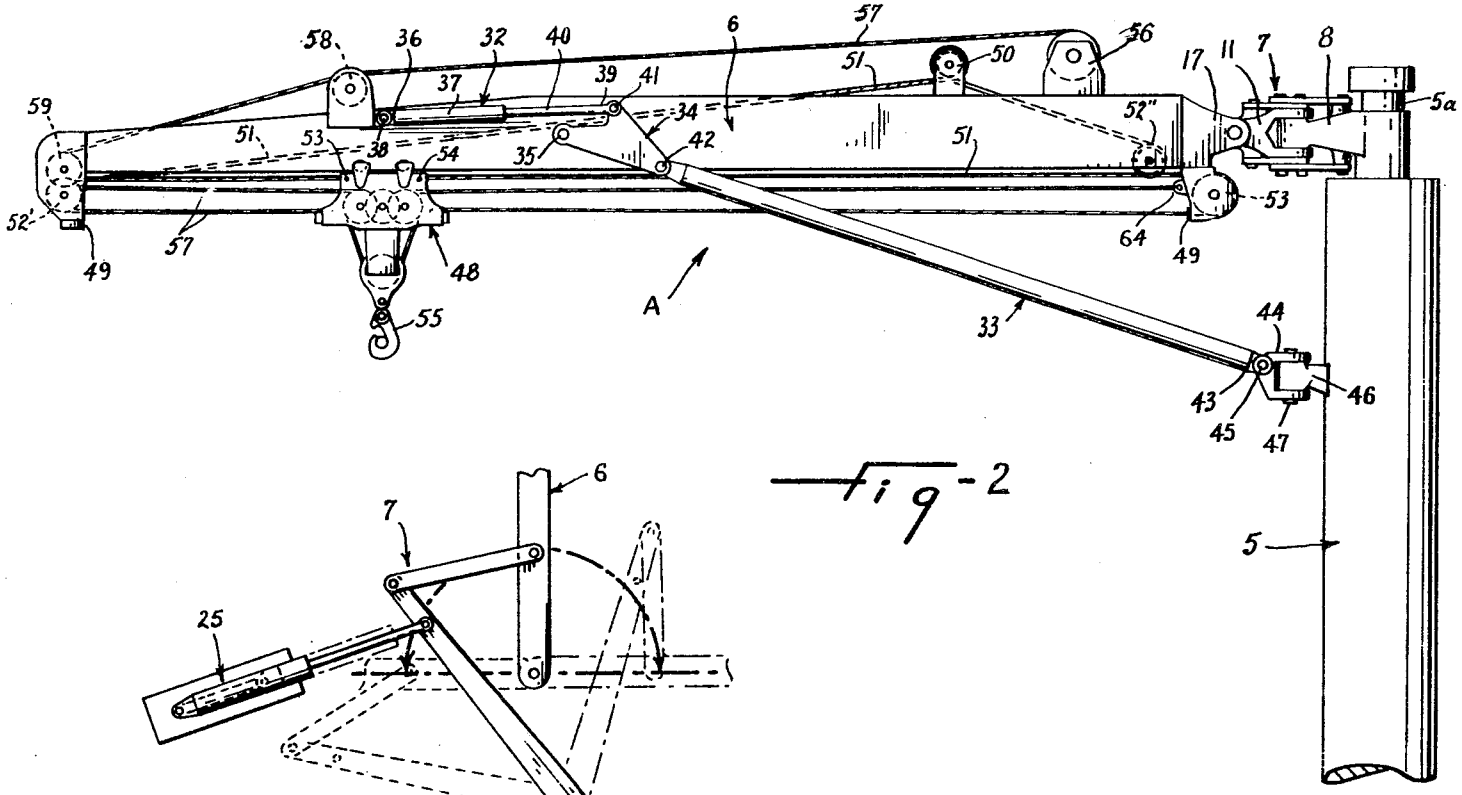
FIG. 2 is a side elevation of one form of the crane showing a single boom mounted on a support post with the boom in the elevated position.

Referring to the drawings, the crane A as particularly shown in FIG. 2 includes a fixed vertical post 5 which can be anchored at its base as a shore installation or be anchored to the deck of a ship. A single boom 6 is pivotally connected at one end to the upper portion of the post 5 by a hinge member 7 in a manner which will allow the boom 6 to be slewed about the post 5 through 180° and at the same time permit the boom to be moved through a vertical plane when the crane is not in use as shown on the right-hand side of the post 5 in FIG. 3.

Figure 3:
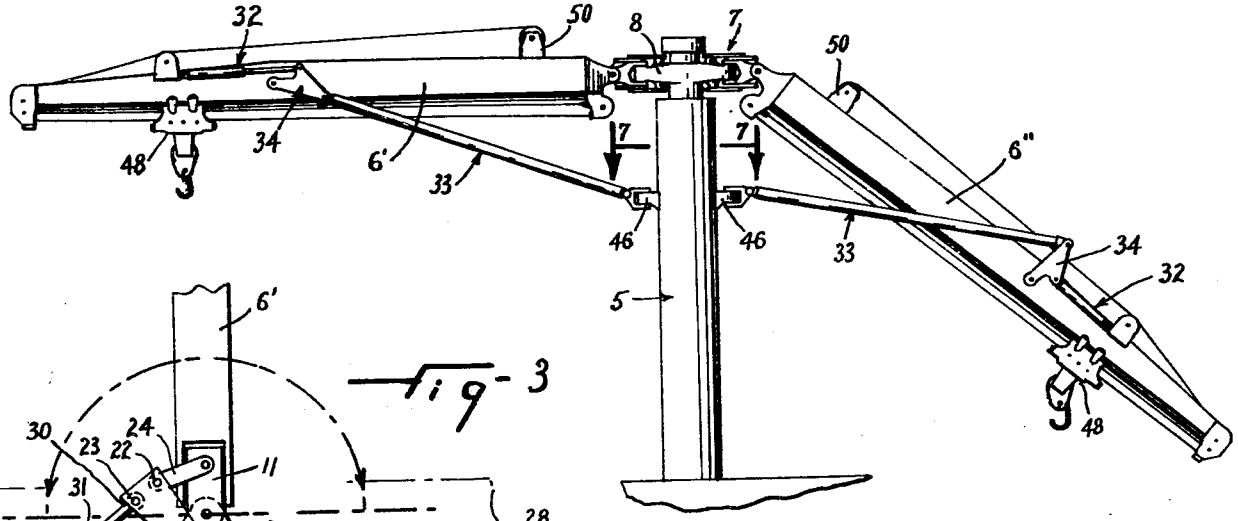
FIG. 3 is a side elevation of a second form of the crane showing a pair of booms mounted on a support post, with one boom shown in the elevated position and the second boom shown in the lowered position.
Figure 7:
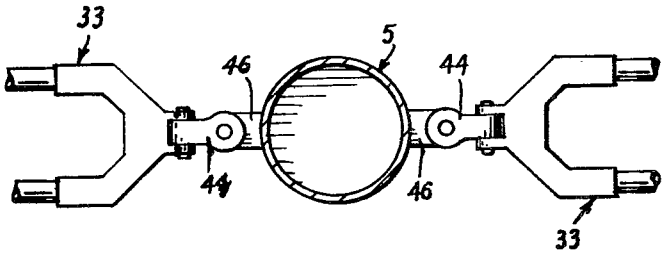
FIG. 7 is a horizontal section taken on the line 7—7 of FIG. 3.
Figure 4:
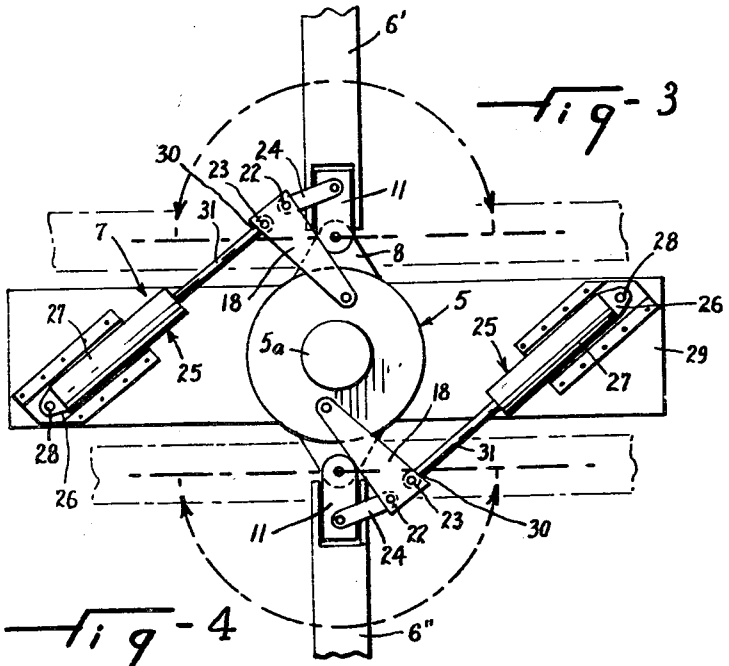
FIG. 4 is a partial plan view of the crane shown in FIG. 3 showing the pair of booms aligned with each other and the operating means for slewing the booms through 180°.

In shore installations of the crane a single boom 6 as shown in FIG. 2 is generally all that is required for efficient load handling; however, where the crane is installed on board ship, a pair of booms 6' and 6'', as shown in FIGS. 3 and 4 is preferably required to permit individual working of the holds of the ship where such holds are located fore and aft of the crane.

The invention will be described with particular reference to shipboard mounting of the crane where a single or a pair of booms are mounted on the post 5.

Figure 5:
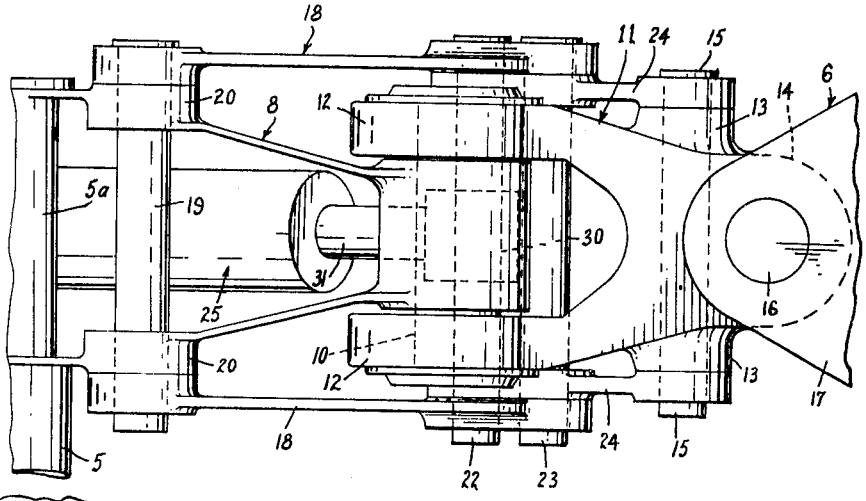
FIG. 5 is an enlarged elevational view of the linkage connection between one boom and the support post taken from FIG. 3.
Figure 6:
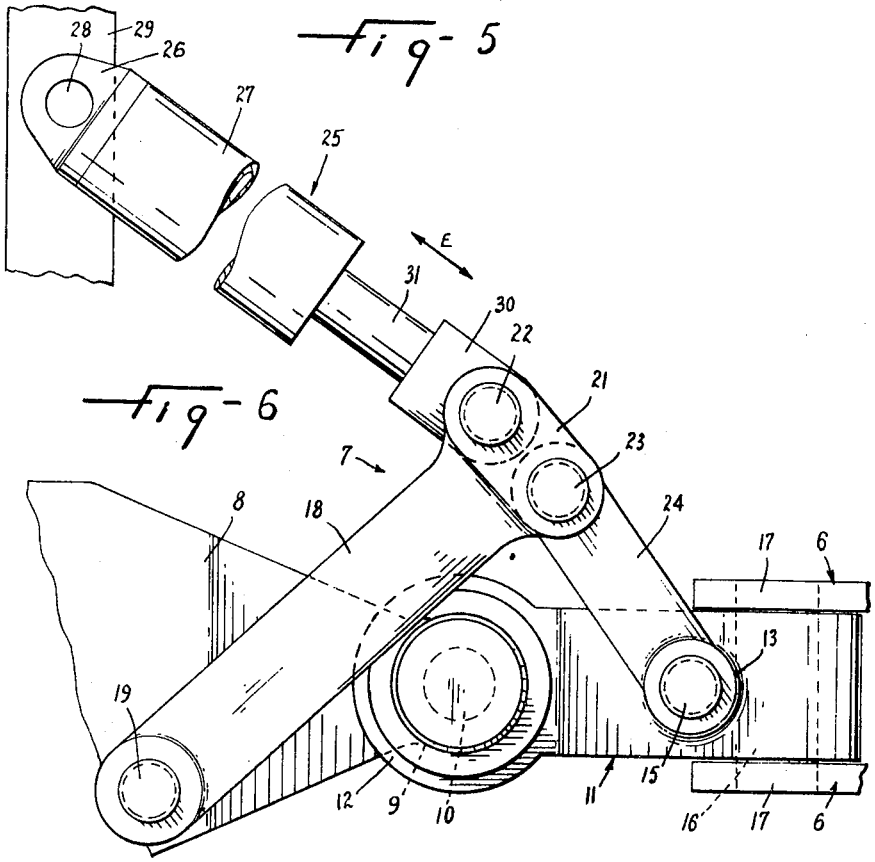
FIG. 6 is an enlarged plan view of the linkage connection shown in FIG. 4 and 5.

Referring particularly to FIGS. 3, 5 and 6, a boom support arm 8, forming a part of the hinge member 7, is mounted on the reduced diameter upward extension 5*a* of the post 5, extends horizontally outwards on opposite sides of the post 5 and terminates at each end in a boss 9 which are bored vertically to receive the pivot pins 10. Clevis-like intermediate members 11 have their fork end portions 12 pivotally mounted on the upper and lower ends of the pivot pins 10. The members 11 each have an upper and a lower vertically disposed boss 13 and a horizontally disposed boss 14 located outwardly of the bosses 13. A vertically disposed pivot pin 15 is secured in the bosses 13 and a horizontally disposed pivot pin 16 is secured in the boss 14.

The inner end 17 of the boom 6 is pivotally mounted on the horizontal pivot pin 16 of the hinge member 7 for movement of the boom 6 through a vertical plane.

Upper and lower link members 18 are pivotally connected at one end by the pivot pin 19 secured in the bosses 20 on the upper and lower surfaces of the support arms 8, as shown in detail in FIGS. 5 and 6. The opposite end of the link members 18 are T-headed at 21 and are drilled to receive the upper and lower ends of the pins 22 and 23 which extend between the upper and lower link members 18. A pair of upper and lower link members 24 connect between the pivot pin 15 on the member 11 and the pin 23 connecting the upper and lower link members 18.

A pair of cylinder and piston devices 25, for individually effecting slewing of each of the booms 6 have the outer ends 26 of the cylinders 27 pivotally mounted on the pivot pins 28 which are secured to the cross member 29 projecting outwardly on opposite sides of the post 5 at right angles to the boom support arm 8. The outer ends 30 of the piston rods 31 are pivotally connected to the pins 22 secured in the end portion 21 of the upper and lower link members 18. Extension and contraction of the piston rods 31 in the cylinder 27 in the direction of the arrows E (FIG. 6) effect rotation of the link members 18 and 24 about the pivot pin 19 thus effecting slewing movement of the booms 6 about the pivot pins 10 on the support arms 8.

Movement of the booms 6 through a vertical plane is controlled by the pair of cylinder and piston devices 32 and the pair of stay members 33, both of which are pivotally connected to the pair of triangular members 34. The triangular members 34 are pivotally mounted, one on either side of the boom 6, intermediate its length, on the pivot pin 35.

The pair of cylinder and piston devices 32 have the outer end 36 their cylinders 37 pivotally mounted on the pivot pins 38 secured on the sides of the boom 6, and the outer ends 39 of the piston rods 40 are connected to the triangular member 34 by the pivot pin 41.

The pair of stay members 33 are each connected at one end to the triangular members 34 by the pivot pins 42 and the opposite end of the stay members 33 are secured to the fork member 43 which is connected to the Clevis 44 by the pivot pin 45. The Clevis 44 is pivotally mounted on the brackets 46 by the pivot pins 47. The brackets 46 are secured on opposite sides of the post 5 longitudinally of the ship.

To complete the crane each boom 6, 6'-6'' has a load carrying trolley 48 adapted for movement along the length of the booms 6 between the end stops 49. Movement of the trolley 48 is controlled by the winch 50, mounted on top of each boom, adjacent to the post 5 and the wire ropes 51 between the winch 50 and trolley 48, passing over the pulleys 52' and 52''.

Control of the operation of the crane in either the single boom form shown in FIG. 2 or in the double boom form shown in FIG. 3, includes fluid lines and valves, not shown, which lead to the cylinder and piston devices 25 and 32. Preferably the valves are located at a convenient location near the base of the posts 5 on which the crane booms are mounted.

As is clearly shown in FIGS. 1, 3 and 4, movement in and out of the piston rods 31 of the piston and cylinder devices 25 and the linkage 7 between the devices 25 and the boom 6 effect uninterrupted movement horizontally of the boom 6, about the pivot pins 10 and 47, through 180° without interfering with the post 5 or the post cross member 29, thus providing for free movement of a load carried at any radial position of the load along the length of the boom.

With the arrangement clearly shown in FIGS. 4 and 6 where the piston rod 31 is connected to the link member 18 at a point other than the point at which the link member 18 is connected to the link member 24, allows for a shorter stroke of the cylinder and piston device 25, thus providing for smoother operation of the boom and less strain on the linkage mechanism between the cylinder and piston device and the boom. 9n

The embodiments of the invention in which an exclusive property or privilege is claimed are defined as follows:

1. A crane having a vertical post; boom means; hinge means connecting the boom means to the post, the hinge means including a support arm mounted on the top of the post and projecting horizontally therefrom, a first vertically disposed pivot pin secured on the outer portion of the support arm, and an intermediate member pivotally mounted at one end on the vertical pivot pin for horizontal movement about the vertical pin, the intermediate member supporting a horizontal pivot pin at its other end; the inner end of the boom means pivotally mounted on the horizontal pivot pin for vertical movement about the horizontal pin; a support member projecting outwardly from the top of the vertical post at right angles to the support arm; moving means for moving the boom means about the pivot pin between a first position where it is substantially at right angles to the support arm on one side of it and a second position where it is substantially at right angles to the support arm on the other side of it; the moving means pivotally mounted at one end to the free end of the support member, the other end pivotally mounted with first vertical pivot means to the free end of first straight link means; the other end of the first straight link means pivotally mounted with second vertical pivot means to the support arm; the first straight link means comprising a pair of vertically-spaced apart horizontal links with the upper link located above the vertical point pin and the lower link located below the vertical pivot pin so as to pass the vertical pivot pin when the boom means moves between the first and second positions; second straight link means, the second straight link means pivotally mounted at one end with third vertical pivot means to the free end of the first straight link means, adjacent the other end of the moving means; the other end of the second straight link means pivotally mounted with fourth vertical pivot means to the intermediate hinge member, the fourth vertical pivot means located adjacent the horizontal pivot pin and spaced from the vertical pivot pin.

2. A crane as claimed in claim 1 including second moving means alongside the boom means for moving the boom means vertically about the horizontal pivot pin; the second moving means pivotally connected at one end to boom means by first horizontal pivot means and by second horizontal pivot means to a plate member intermediate its ends; the plate member positioned alongside the boom means between the second moving means and the post, and pivotally connected at its end adjacent the second moving means to the boom means by third horizontal pivot means; the other end of the plate member connected by fourth horizontal pivot means to one end of a stay member, the other end of the stay member connected by universal means to the post at a location spaced below the hinge means.

* * * * *